US006073678A

United States Patent [19]

Garza-Ondarza et al.

[11] Patent Number: 6,073,678

[45] **Date of Patent: *Jun. 13, 2000**

[54] METHOD AND APPARATUS FOR PRODUCTION OF ALUMINUM ALLOY CASTINGS

[75] Inventors: Oscar Garza-Ondarza, San Nicolás de los Garza; Gerardo Salinas-Peña, Monterrey; Octavio Juan Ochoa-Rodríguez, Monterrey; David Hugo Carrillo-Cantú , Monterrey, all of Mexico

[73] Assignee: Tenedora Nemak S.A. de C.V., Garcia, Mexico

[ * ] Notice: This patent is subject to a terminal disclaimer.

[21] Appl. No.: 09/072,423

[22] Filed: May 4, 1998

Related U.S. Application Data

[63] Continuation-in-part of application No. 08/740,313, Oct. 28, 1996, Pat. No. 5,778,962.

[51] Int. Cl.[7] ..... B22D 47/00

[52] U.S. Cl. ..... 164/130; 164/323; 164/337; 164/136

[58] Field of Search ..... 164/130, 323, 164/337, 136, 129

[56] References Cited

U.S. PATENT DOCUMENTS

| | | | |
|---|---|---|---|
| 2,338,153 | 1/1944 | Whittaker | 22/64 |
| 3,530,571 | 9/1970 | Perry | 29/563 |
| 3,627,028 | 12/1971 | Carignan | 164/323 |
| 3,977,461 | 8/1976 | Pol et al. | 164/155 |
| 3,989,090 | 11/1976 | Kawai | 164/228 |
| 4,299,269 | 11/1981 | Friesen et al. | 164/324 |
| 4,422,495 | 12/1983 | Van Nette, III | 164/324 |
| 4,747,444 | 5/1988 | Wasem et al. | 164/457 |
| 5,056,584 | 10/1991 | Seaton | 164/457 |
| 5,778,962 | 7/1998 | Garza-Ondarza et al. | 164/130 |

FOREIGN PATENT DOCUMENTS

| | | | |
|---|---|---|---|
| 59/87970 | 11/1982 | Japan | B22D 47/02 |
| 59-087970 | 5/1984 | Japan . | |
| 2067940 | 8/1981 | United Kingdom | 164/323 |

*Primary Examiner*—Harold Pyon
*Assistant Examiner*—I.-H. Lin
*Attorney, Agent, or Firm*—A. Thomas S. Safford; Frommer Lawrence & Haug LLP

[57] ABSTRACT

Method and simplified apparatus for manufacturing aluminum alloys castings, for example those cast aluminum parts utilized in the manufacture of automobile engines: cylinder heads, engine blocks and the like; whereby the castings are cast in a plurality of semi-permanent-type molds, said molds each being movable to a plurality of processing positions along one of a plurality of preferably straight line paths (five in the preferred embodiment), wherein the operations of cleaning, core setting, casting, and casting extraction are performed on each mold at predetermined positions along its respective path and alternating said operations among the molds in order to permit minimization of the number of robot equipment and to increase the aggregate productivity of said molds, since any one processing operation can be handled by only a few (and preferably only one) robot arm moving across a plurality of mold paths (preferably seriatim), so that a given process step is performed at any one time only at one (or at least significantly fewer than all) of the plurality of mold paths.

20 Claims, 6 Drawing Sheets

METHOD AND APPARATUS FOR PRODUCTION OF ALUMINUM ALLOY CASTINGS

RELATED APPLICATIONS

This application is a continuation-in-part of and claims at least partial priority from application Ser. No. 08/740,313, filed Oct. 28, 1996 and now issued as U.S. Pat. No. 5,778,962.

FIELD OF THE INVENTION

The present invention relates to an improved method and apparatus for the production of aluminum alloy castings, more particularly, to a production plant comprising a plurality of movable semi-permanent molds which are positioned in different stations corresponding to the activity being performed in the production cycle, thereby raising the productivity of the casting process and lowering the capital and maintenance costs of the currently used casting equipment.

BACKGROUND OF THE INVENTION

Production of aluminum alloy castings, for example massive production of certain automobile engine parts, (such as cylinder heads), is usually made in permanent or semi-permanent type molds, in contrast with expendable molds made of sand which are used for only one casting. The semi-permanent molds are provided with means for heating, cooling, automatic opening and closing, etc. to complete a full casting cycle. Usually one operator serves several molds, and some operations such as core setting, mold filling, and extraction of the casting are made with the help of robot arms, programmed for performing these repetitive operations with accuracy in time and space.

The production cycle of the casting process comprises the following operations, directly related to the mold: (A) mold cleaning; (B) core setting; (C) mold filling and cooling; and (D)extraction of casting, followed by breaking and elimination of external sand cores and removal of runners. The casting is then heat-treated, if necessary, finished and inspected. The production process currently in operation involves the use of fixed semi-permanent molds. One such process requires at least one operator and three robots per mold. An alternative process uses a revolving platform, typically with 4 to 6 molds mounted thereon, which are served by two or three operators and three robots for said five molds. The productivity of the revolving platforms has been relatively satisfactory but can be improved according to the present invention. The revolving platform also has some drawbacks, for example the mass of the revolving platform is on the order of 50 metric tons, which requires high capacity motors and equipment to rotate it from one station to the next. Also, if one of the molds breaks down and has to be repaired, most of the time, the whole platform has to be shut down with the consequent loss of production of the other molds thereon.

The present invention overcomes the disadvantages of the presently utilized revolving platforms and allows for higher productivity of the casting process.

This invention thus results in multimillion dollar savings in capital investment and upkeep costs of the revolving platforms and the maintenance costs of such equipment. The casting plants are therefore greatly simplified.

There have been some proposals in the past addressed to upgrade the efficiency of foundries, where molds undergo a sequence of operations. All of prior art shows circular paths along which the molds circulate and are positioned at several stations for performing the required operations. Examples of the prior art are found in U.S. Pat. No. 3,627,028 to Carignan, U.S. Pat. No. 4,747,444 to Wasem et al, U.S. Pat. No. 4,299,629 to Friesen el al., U.S. Pat. No. 4,422,495 to Van Nette, U.S. Pat. No. 3,530,571 to Perry, U.S. Pat. No. 5,056,584 to Seaton and U.S. Pat. No. 3,977,461 to Pol et al. None of these patents however teach or suggest the arrangement proposed by the Applicants and its advantages in productivity. Some of these patents teach for example to synchronize the movement of the molds with the movement of ladles containing the liquid metal, but none suggest to have linear paths for the molds along which the molds can travel and meet the servicing robots for pouring the molten aluminum and extracting the casting one at a time and each one under wholly independent operation of the others. The prior art does not suggest to include one station where each mold can be positioned for maintenance, which is practical in the linear path arrangement and not in circular paths, where the molds can be positioned when needed without interfering in any way with the casting cycle of the other molds.

OBJECTS AND SUMMARY OF THE INVENTION

It is therefore an object of the invention to provide a process of manufacturing aluminum alloy castings with improved productivity and at lower capital and operational costs.

It is another object of the invention to provide a new lay-out of the equipment involved in the manufacturing of aluminum alloy castings with higher flexibility and productivity.

Other objects of the invention will be in part obvious and in part pointed out hereinafter.

According to the present invention the objects thereof are achieved by providing (1) a method of manufacturing aluminum alloy castings comprising using a system having a plurality of molds independently movable along adjacent linear paths with one mold to each path, a liquid aluminum holding furnace, and a plurality of robots movable along adjacent linear paths which cross the paths of the molds at automated processing positions, the respective path for each mold including at least a casting pour position and a separate casting extraction position by moving each mold along its respective linear path to successively position each mold at predetermined processing positions in its respective path according to a scheduled order of process steps for manufacturing said aluminum alloy castings, cyclically positioning said molds at said predetermined processing positions in their respective paths such that the operation of filling said molds with liquid aluminum to form a casting is done for at least several molds successively by at least one robot moving along a path including said furnace, and the operation of extracting at least several of said castings from the molds is carried out by at least another robot moving along a different path; and further by providing (2) an apparatus for producing aluminum alloy castings in a system comprising a plurality of molds, a liquid aluminum holding furnace serving at least several molds in said system, a plurality of linear independent mold paths along which each mold is respectively moved and positioned at predetermined processing positions in its corresponding path with each path including at least a casting pour position and at least a casting extracting position, at least two robots: one for pouring liquid aluminum into at least several molds and the other for extracting at least several solidified castings from the molds, said robots each being movable along a respective path which intercepts the paths of the molds at the pouring positions and at the extracting positions respectively; means for cyclically positioning said molds at said predetermined positions in their respective paths.

More generally, it can be seen that the original invention in this and its parent application broadly discloses that a system of molds, each individually moveable along its own path with the mold paths collectively being side by side (preferably in straight lines), are crossed by a plurality of side by side operational paths along which automated processing equipment (e.g. robot) travel, so that each item of such equipment can service more than one mold and can do so largely independently of the positioning of the other molds. This grid like layout gives efficiency but without limiting flexibility (such that if one mold breaks down or otherwise is taken out of service, the other molds can still functionally continue to produce castings).

In one preferred embodiment, each of the mold paths will accommodate only one mold, and each of the processing paths will accommodate only one piece of processing equipment per path. Alternatively, some but not all of the processing equipment can move along the same paths (where the timing and sequence of operations permit). In a further alternative embodiment, the basic simple grid arrangement can be repeated laterally, rather than longitudinally, with some operations shared in common (such as the maintenance areas); whereby the common area is more compact. Also, there is sufficient flexibility, so that the operations do not have to be preformed in an exact sequence or at set timed intervals. For example, if in the normal rotation the casting pour is normally into the second mold before the third mold, with a delay in the second the third can be filled first if it is ready first.

BRIEF DESCRIPTION OF THE DRAWINGS

In this specification and in the accompanying drawings, some preferred embodiments of the invention are shown and described and various alternatives and modifications thereof have been suggested; but it is to be understood that these changes and modifications can be made within the scope of the invention. The suggestions herein are selected and included for purposes of illustration in order that others skilled in the art will more fully understand the invention and the principles thereof and will thus be enabled to modify it in a variety of forms, each as may be best suited to the conditions of a particular use.

DETAILED DESCRIPTION OF PREFERRED EMBODIMENTS OF THE INVENTION

Figure 1:
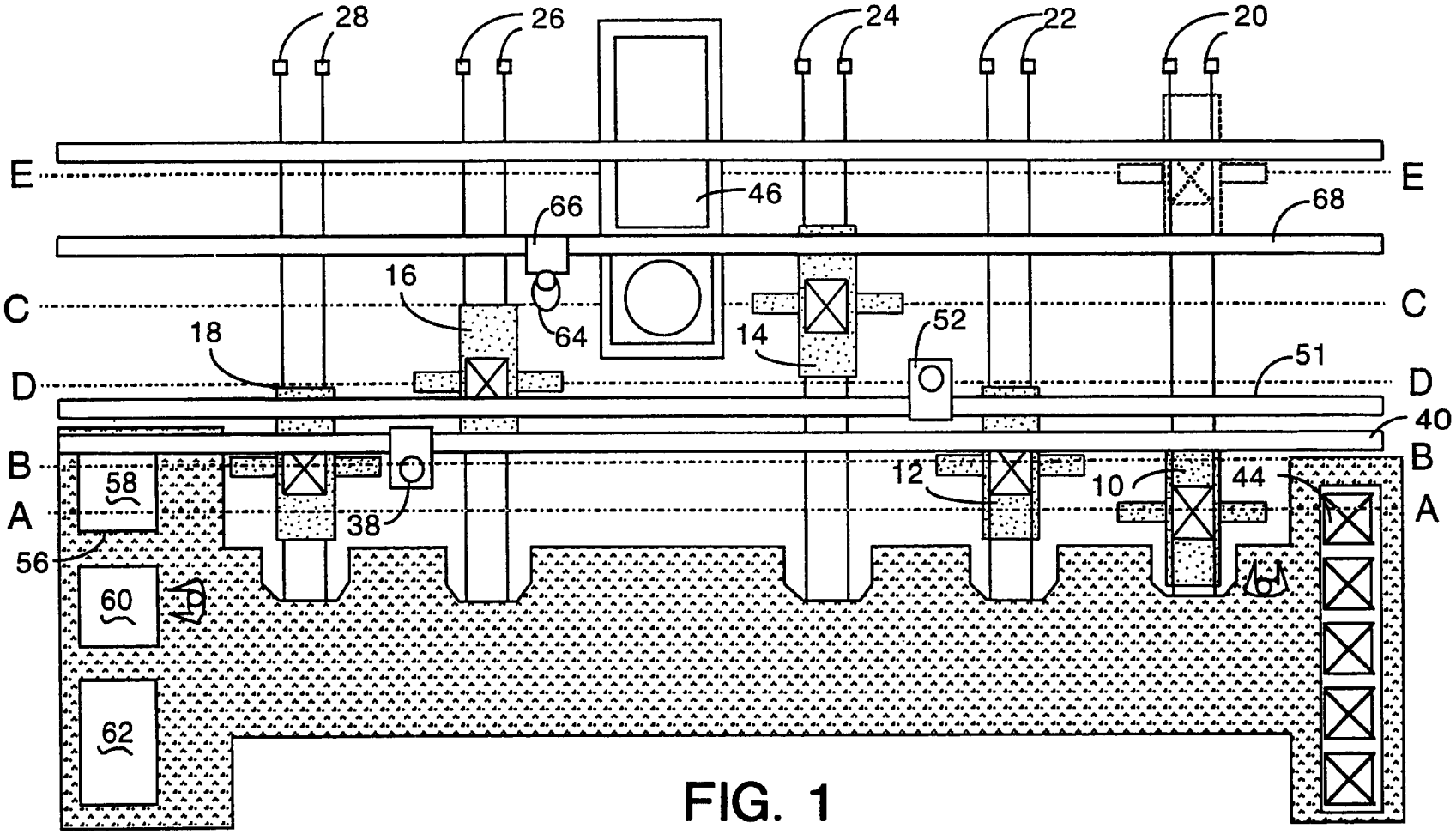
FIG. 1 is a schematic plan view illustrating the lay-out of the casting system according to the present invention and particularly showing the sequence of positions A to E taken by each of a plurality of molds moving along a respective one of a plurality of parallel tracks to carry out the linearly staggered process steps A to D for producing aluminum castings.

The casting process of most aluminum alloy castings comprise the following steps:

(A) Mold cleaning. This operation involves inspection by an operator of the mold in order to assure that the casting will be free of defects caused by inclusion of foreign elements, and cleaning of loose sand and other materials (B) Core setting. This operation is usually performed with the help of a first robot arm 38 for easing the operator's work and because of the repetitive nature of the operation. The robot arm is programmed for accurately placing at least one core in its position within the mold in a given line and to repeat the process for each other mold in the other lines. In the prior art revolving platform system, a similar robot arm serves the all molds, typically four to six, located on the platform.

(C) Casting. The filling of molds 10, 12, 14, 16, and 18 with liquid aluminum is carried out by means of a second robot arm 66 having a small ladle 64, which is filled by immersion, by an autoladle, or the like, from a molten aluminum pool held nearby in a holding furnace 46. The ladle 64 pours the measured amount of liquid aluminum into one of the respective molds, each in its turn. One robot arm for this purpose is used in the prior art rotating platform systems.

(D) Extraction. The casting 48, including the sand core(s) 36, is then withdrawn from the mold with the help of a third robot arm 52 as soon as the casting 48 has undergone sufficient cooling so as to be sufficiently solidified to be handled outside of the mold. The mold is provided with a cooling system (not specifically described, many of which are commonly-known) in order to carry out the cooling process of the casting.

The four steps A to D as illustrated in FIGS. 1 to 5 take place each at different times in each of the five or more adjoining lines 20, 22, 24, 26 and 28, so as to thereby be enabled to share a single respective robot device for each respective process step among the lines.

Figure 2:
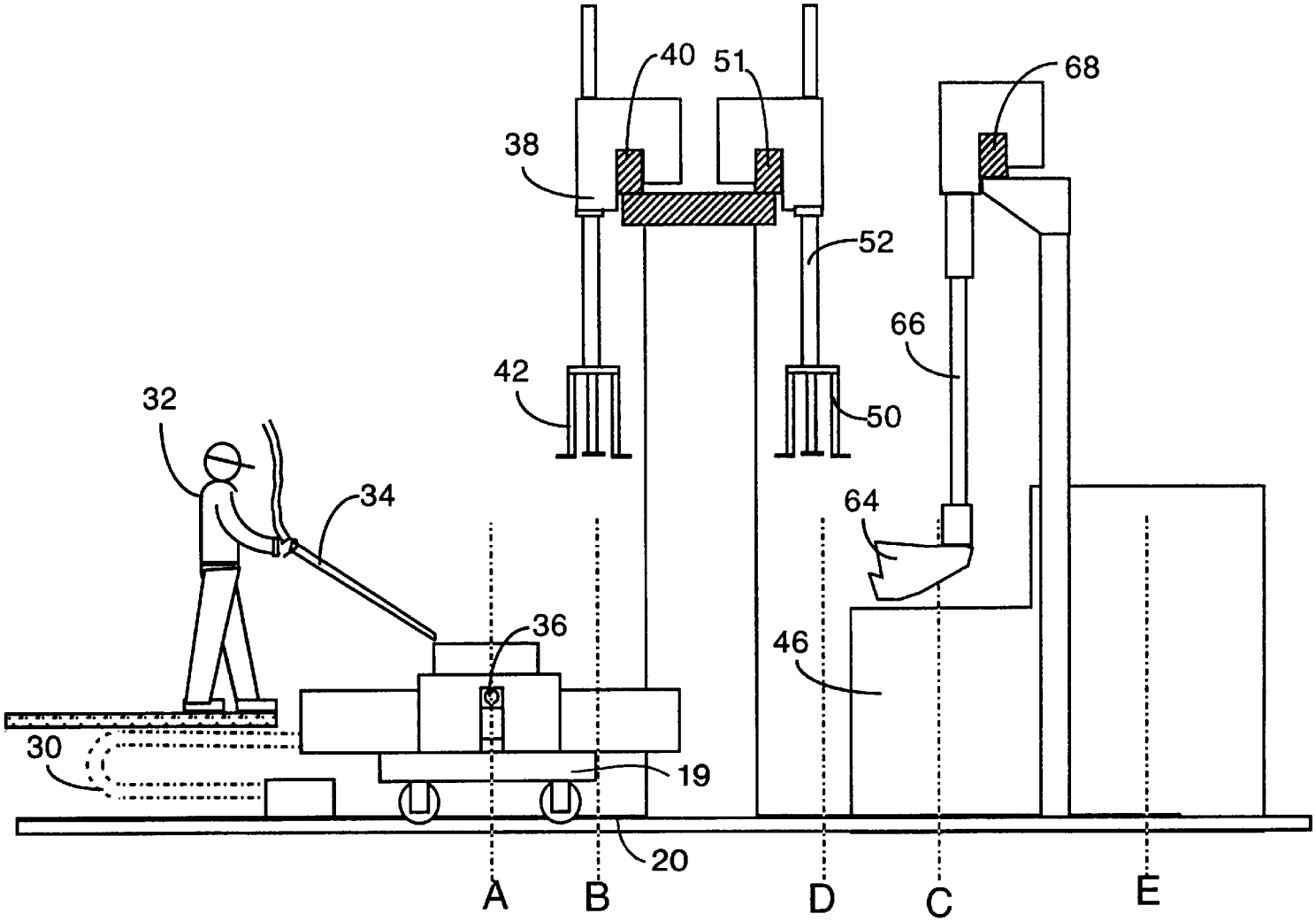
FIG. 2 is a schematic side elevational view of the casting system shown in FIG. 1, illustrating mainly the sequence of operations A to E along one of the processing tracks, as well as the tracks of the robots for core setting, casting and extraction of the castings.
Figure 3:
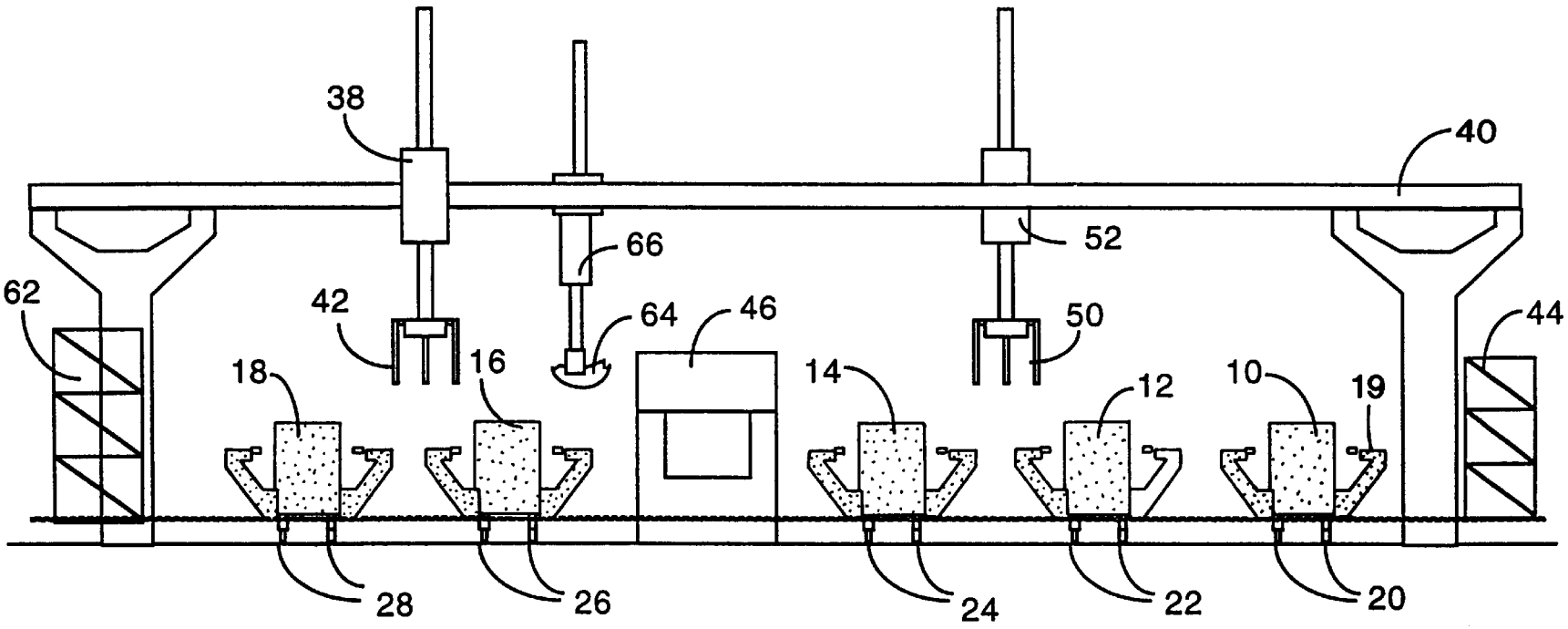
FIG. 3 is a schematic side elevational view of the casting system shown in FIG. 1, illustrating mainly the distribution of the mold cradles and the position of the aluminum holding furnace.

Referring to FIGS. 1, 2 and 3, numerals 10, 12, 14, 16 and 18 designate a set of five aluminum alloy casting semi-permanent molds, for example molds for producing automotive cylinder heads. Each mold, carried in a respective wheeled cradle 19 (typically in the art referred to as a "bench"), can be positioned at different operation positions: (A), (B), (C) or (D), along a plurality of linear paths, here illustrated and defined in the preferred embodiment by straight dual tracks 20, 22, 24, 26 and 28. Position (E) is an out-of-service maintenance position. A large linked chain 30 serves as a protective carrier in each line for wiring and hoses for compressed air, hydraulic power and cooling water. In the preferred embodiment, each mold cradle 19 is independently driven for example by an electric motor (not shown). Any other effective motive device can be used to move and position each mold cradle 19 along its respective track.

Position (A) is the first step in the casting cycle initiated for a given mold. This is the position nearest to the operator 32 and is where the mold is cleaned, usually by compressed air, e.g. from probe 34, which aternatively can be automated, and is also inspected and cleaned as necessary to prevent any defects due, for example, to the presence of extraneous matter in the mold. After this operation at position (A) is performed, the mold is moved to position (B) where the sand core(s) 36 is placed inside the mold by means of robot arm 38. By running along overhead rail 40, the robot arm 38, with its gripping device 42, places the core(s) 36 obtained from core baskets 44 in turn into each of the molds, 10, 12, 14 16 and 18. The mold is then closed and moved to casting position (C), where it is filled with liquid aluminum taken from holding furnace 46 by means of ladle 64 mounted on robot arm 66. Robot arm 66 similarly runs along its own overhead rail 68, enabling it also to serve each of the four molds in the system, one at a time. After the casting and cooling cycle, the mold is moved back to position (D), where the casting 48 is withdrawn from the mold by means of an extractor/holding device 50 mounted on robot arm 52 running along overhead rail 51.

Fumes evolving during the casting and extraction operations are withdrawn through suitable conduits (not all being shown, to simplify the drawings) when the casting operation is being carried out. Fume conduits 54 are suitably provided for each mold at the positions where fumes and vapors evolve.

Once the casting 48 is extracted from the mold by robot arm 52, it can be further processed off-line, if required, typically as follows: the casting 48, initially delivered by robot arm 52 along rail 51 to station 56, where the bulk of the residuum of the sand cores 36 is removed, it is then moved along to station 58, where the excess aluminum alloy material solidified in the runners and top of the casting is cut and removed, then to quench tank 60 for quenching, then onto inspection table 62, and finally after inspection, it is placed in a basket to continue any following heat treating and/or finishing processes.

The casting system claimed herein provides a number of advantages over the prior art, for example the capital cost is considerably lower, on the order of 40% less than the cost of the systems comprising rotating tables with 5 molds on each table. The amount of equipment parts and installation time is lower too. Maintenance costs are reduced because the individual moving molds of this system according to the present invention have a smaller mass to be moved along the successive processing positions of each casting cycle. The overall productivity is increased, because if one of the molds is subject to failure or requires to be changed, the other molds respectively moving along the other parallel production lines can continue their production cycle. Conversely, with the rotating tables, when one mold stops the production of the other molds is also interrupted. Energy costs are also reduced, again because the moving equipment is lighter than the mass of the rotating tables. The productivity of the system is also increased by reason of the shorter cycle time for moving each mold to the different positions as compared to the cycle time taken for the rotating tables to accelerate, rotate (typically about 36° to 72° ) and brake to stop a massive structure of about 50 metric tons at the respective production positions.

The multiple in-line moving molds system provides also the capability of simultaneously producing two or more different products. Although the invention has been exemplified showing a system having five molds, it will be evident that at least two molds can be operated and that more than five molds can also provide the advantages of the invention, especially if the mold casting operation has more or less than 4 automatable processing steps. Also, the core setting can be done manually or combined with a robot arm in case products are being cast from two or more molds. Also, if applied to permanent molds, there would be no need for setting expendable cores, so step B could be eliminated. The thus simplified invention would still be advantageous over the current practices in this art.

Figure 4:
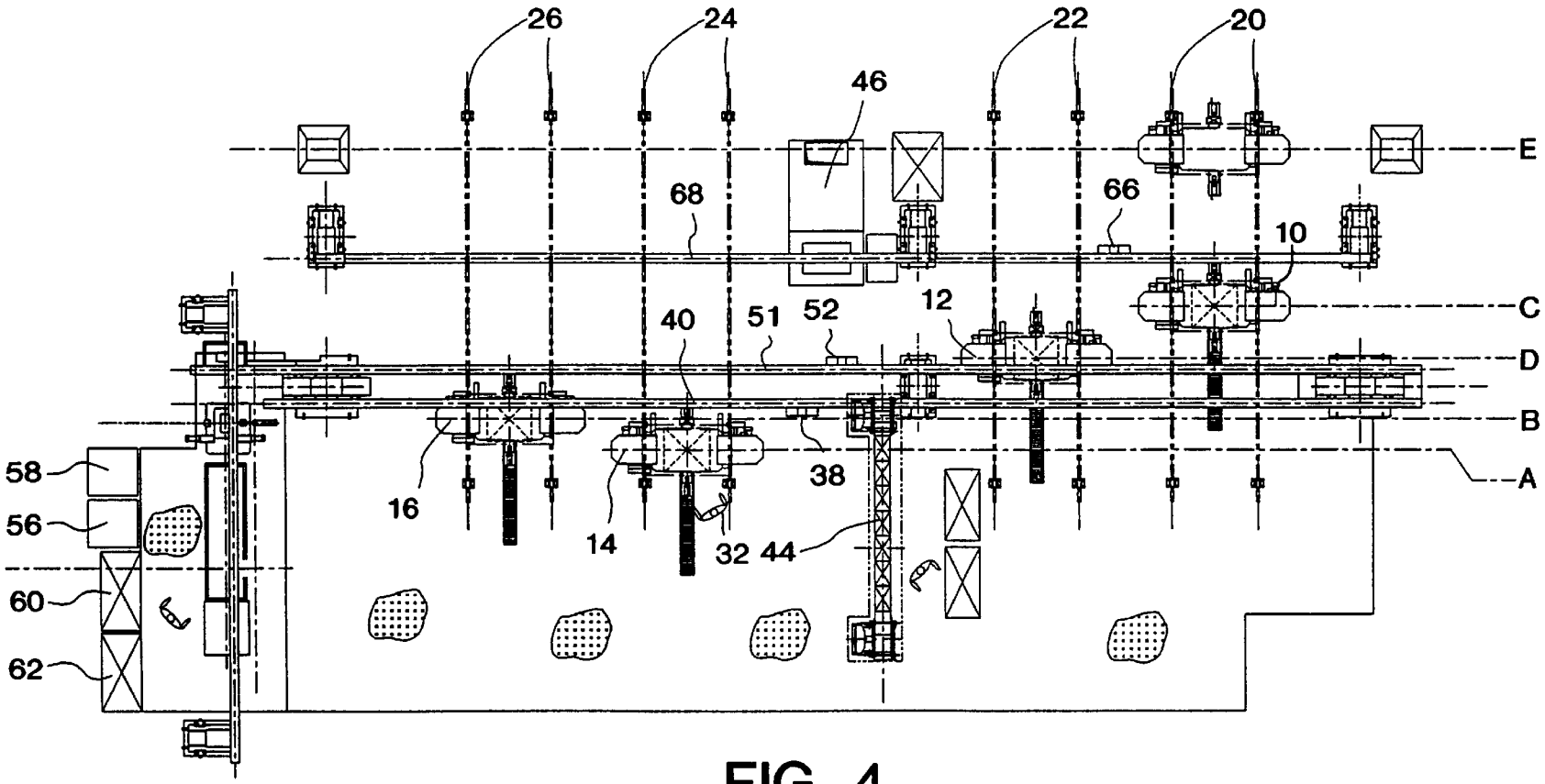
FIG. 4 is a schematic plan view (similar to FIG. 1) of a casting system showing another embodiment of the invention wherein the number of moving molds is four and wherein the orientation of said molds is different as compared to the orientation of the molds in FIG. 1.
Figure 5:
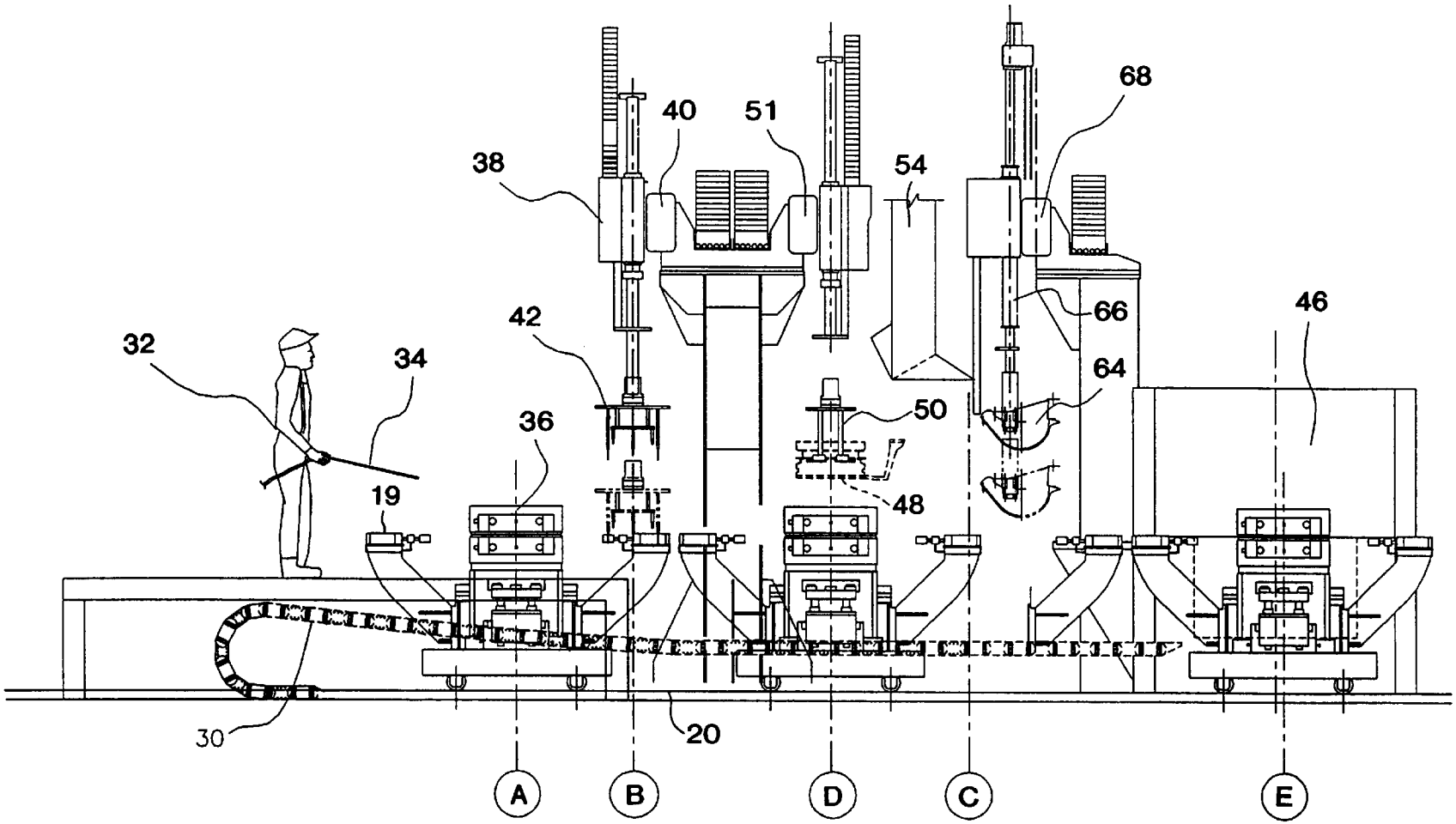
FIG. 5 is an elevational schematic view of the casting system shown in FIG. 4.

Although the invention has been described as a preferred embodiment comprising five molds, a second embodiment is also illustrated with reference to FIGS. 4 and 5 wherein the casting system has only four molds oriented differently, so that the operator is given a wider access to the whole area of the mold. In these FIGS. 4 and 5 the location of some other elements has been modified but preserving the essential feature of the invention, i.e. that each mold moves in a substantially straight line and that said molds are positioned in certain positions located in said linear tracks for carrying out the operations of the casting cycle for fabrication of aluminum castings. For convenience and simplification of this description, the same numerals used in FIGS. 4 and 5 designate similar or equivalent elements as in FIGS. 1, 2 and 3. The description of FIGS. 1 to 3 also applies to the embodiment shown in FIGS. 4 and 5, with the characteristic of having only four molds in a different orientation. Also, in FIGS. 4 and 5 the positions of the molds have been shown with dotted lines on the same track to show the movement thereof without implying that several molds move on the same track.

Figure 6:
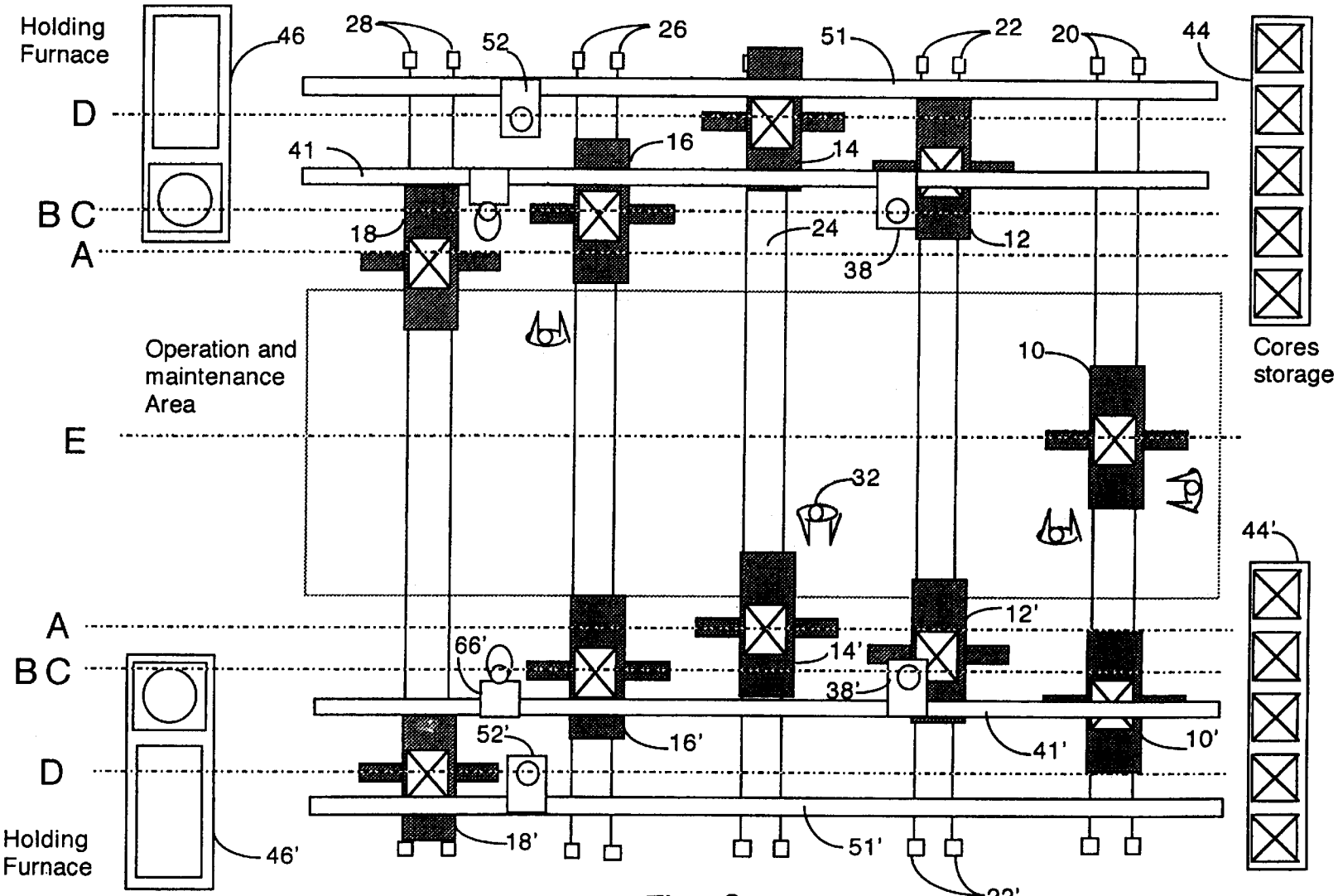
FIG. 6 is a schematic plan view (similar to FIG. 1) of a casting system showing yet another embodiment of the invention having a particularly efficient layout wherein there is a dual "mirror image" duplication of the system in FIG. 1 modified to share a common maintenance area E and combine the location of the metal pouring and core setting operations C & D by having the respective robots for the C & D operations move along a common overhead rail.

A preferred third embodiment is illustrated in FIG. 6 wherein a more compact dual casting system is shown. Again, for convenience and simplification of the description, the same numerals used in FIGS. 1 to 5 have been used in FIG. 6 to designate similar or equivalent elements; while in FIG. 6 itself, where there are duplicate elements in the second of the combined systems, the reference numbers used for those duplicate elements have been differentiated by use of a prime (′). The principal difference between the embodiment of FIG. 6 and the other illustrated embodiments is its compactness resulting from having a dual system (one system on either side of the commonly-shared maintenance area E) and from having the core setting 66, 66′ and the pouring ladle 38,38′ run on the same overhead rail 41,41′. The combining of separate rails 40 and 68 into a single rail 41 (or 41′) is possible, because the core setting B operation and the pouring C operation (30 seconds, to prevent dimensional changes) are very quick relative to the cooling required prior to the extraction D. Other layout modifications and sharing of common items can be adopted as modifications depending upon the process requirements enabling better efficiencies of time and money with flexibility operation permit (including the ability to meet different process requirements as the type of molds carried by the "bench" may change from job to job). For example, the holding furnaces 46 and 46′ could be a single source (possibly with two different dipping pools) or could be two completely separate furnaces altogether (as illustrated in FIG. 6). Each of the mold tracks 20 etc. can define a path devoted exclusively to only one mold per path (as in FIGS. 1 to 5), or have a plurality of molds per path (as illustrated on tracks 20 etc. in FIG. 6). In FIG. 6, the molds 10 and 10′ are on the same track but normally would overlap only in the maintenance area (not being physically constructed to easily move into the system of the other, i.e. mold 10 would not normally be served by robots 38', 52', or 66'). However, if the economics of the equipment and process were such as to make the use of a plurality of molds in a single line effective, then the grid concept of the present invention in its broader aspects has and does support and cover such variation. Similarly, when economically effective, more than one robot for a given processing task (such as the core setting task) can be operative along a given processing path (whereby if one becomes inoperative, the other(s) can continue to function and, where unobstructed, service all of the molds whose paths intersect such processing path).

With respect to the general descriptions of FIGS. 1 to 5, these also apply to the embodiment shown in FIG. 6.

What is claimed is:

1. A method of manufacturing aluminum alloy castings comprising:

using a system having a plurality of molds independently movable along adjacent linear paths with at least one mold per path, a liquid aluminum holding furnace, and a plurality of robots movable along adjacent linear paths which cross the paths of the molds at automated processing positions, the respective path for each mold including at least a casting pour position and a separate casting extraction position by moving each mold along its respective linear path to successively position each mold at predetermined processing positions in its respective path according to an order of process steps appropriate for manufacturing said aluminum alloy castings, positioning said molds at said predetermined processing positions in their respective paths such that the operation of filling said molds with liquid aluminum to form a casting is done for at least several molds successively by at least one robot moving along a path including said furnace, and the operation of extracting at least several of said castings from the molds is carried out by at least another robot moving along a different path.

2. The method according to claim 1, further comprising an operation of core setting done for at least several molds successively by at least one robot moving along a path crossing the linear paths of the molds thus defining core setting processing positions at the intersections of the crossing paths.

3. The method according to claim 2, wherein there is only one mold per mold containing path.

4. The method according to claim 3, wherein the path of the robot for the core setting operation is different from the paths of robots for casting pour and casting extraction operations.

5. The method according to claim 4, wherein there is only one holding furnace, and all the paths are essentially straight.

6. The method according to claim 2, wherein the path of the robot for the core operation is the same as the path for the robot for the operation of filling said molds with liquid aluminum to form a casting.

7. The method according to claim 6, further comprising using a dual system with one part mirroring the other and both sharing a common maintenance area, and wherein the paths of one part of the dual system are extensions of the respective paths of the other.

8. The method according to claim 7, wherein all of the paths are essentially straight.

9. The method according to claim 6, wherein there is only one holding furnace, and all the paths are essentially straight.

10. Apparatus for producing aluminum alloy castings in a system comprising:

a plurality of molds, a liquid aluminum holding furnace serving at least several molds in said system, a plurality of linear independent mold paths along which each mold is respectively moveable and positionable at predetermined aluminum alloy production processing positions in its corresponding mold path, each given mold path including at least two processing positions comprising a casting pour position and a casting extracting position with the presence in each such given mold path of one mold for each repeat of said two process positions, at least two robots: one for pouring liquid aluminum into at least several molds and the other for extracting solidified castings from at least several molds, said robots each being movable along a respective robot path which intercepts the paths of the molds at the pouring positions and at the extracting positions respectively, and means for cyclically positioning said molds at said predetermined positions in their respective paths.

11. The apparatus according to claim 10, further comprising at least one third robot for core setting.

12. The apparatus according to claim 11, wherein the path of each robot for core setting is different from the paths of all other operations, there is only one holding furnace, and all the paths are essentially straight.

13. The apparatus according to claim 11, wherein the path of each robot for core setting is the same as the path for a robot for liquid aluminum pouring.

14. The apparatus according to claim 13, further comprising a dual system with one part mirroring the other and both sharing a common maintenance area, and wherein the paths of one part of the dual system are extensions of the respective paths of the other.

15. The apparatus according to claim 14, wherein all of the paths are essentially straight.

16. The apparatus according to claim 15, wherein there is only one furnace supplying all the robots for pouring liquid aluminum.

17. The apparatus according to claim 15, wherein there is at least one furnace in each of the mirrored parts of the dual system to supply the robots for pouring liquid aluminum in such respective part of the dual system.

18. The apparatus according to claim 15, wherein said mold paths are defined by rail tracks, said molds are mounted on carriages which move along said tracks, and said robot paths are defined by overhead rails.

19. The apparatus according to claim 13, wherein the system has only one of each kind of robot, thus consisting of a unitary system.

20. The apparatus according to claim 10, wherein said mold paths are defined by rail tracks, said molds are mounted on carriages which move along said tracks, and said robot paths are defined by overhead rails.

* * * * *